United States Patent [19]

Myers et al.

[11] 4,151,921

[45] May 1, 1979

[54] MEANS FOR COUNTERBALANCING A MATERIAL HANDLING MACHINE

[75] Inventors: Jimmy D. Myers, Morton; Joseph C. Sabo, Peoria, both of Ill.

[73] Assignee: Caterpillar Tractor Co., Peoria, Ill.

[21] Appl. No.: 845,199

[22] Filed: Oct. 25, 1977

[51] Int. Cl.[2] ..... E02F 9/18

[52] U.S. Cl. ..... 414/719; 212/49; 280/759

[58] Field of Search ..... 214/142; 212/48, 49; 280/759

[56] References Cited

U.S. PATENT DOCUMENTS

| | | | |
|---|---|---|---|
| 3,533,524 | 10/1970 | Wilcox | 214/142 |
| 3,795,330 | 3/1974 | Jorgensen et al. | 214/142 |
| 3,991,891 | 11/1976 | Cox | 214/142 |
| 3,998,342 | 12/1976 | Myers | 214/142 |

FOREIGN PATENT DOCUMENTS

| | | | |
|---|---|---|---|
| 2117700 | 10/1971 | Fed. Rep. of Germany | 214/142 |

*Primary Examiner*—Francis S. Husar
*Assistant Examiner*—Ross Weaver
*Attorney, Agent, or Firm*—Wegner, Stellman, McCord, Wiles & Wood

[57] ABSTRACT

An improved counterbalancing structure for counterbalancing a material handling machine having an elevated operator compartment wherein the counterbalancing counterweight is picked up by means of a material handling structure carried on lift arms at one end of the machine. The counterweight is provided with an upper hooking portion which is disposed in the line of sight of an operator in a normal operating position in the operator compartment with the lift arms and material handling structure being disposed below the line of the sight of the operator in a lowermost pickup position thereof. The counterweight may include a weight portion having a low center of gravity. The upper hooking portion may be defined by a bracket portion of the counterweight extending substantially upwardly from the weight portion thereof. The material handling structure of the machine may be provided with an upwardly projecting bracket which is similarly in the line of sight of the operator during the counterweight pickup operation.

12 Claims, 5 Drawing Figures

FIG. 1
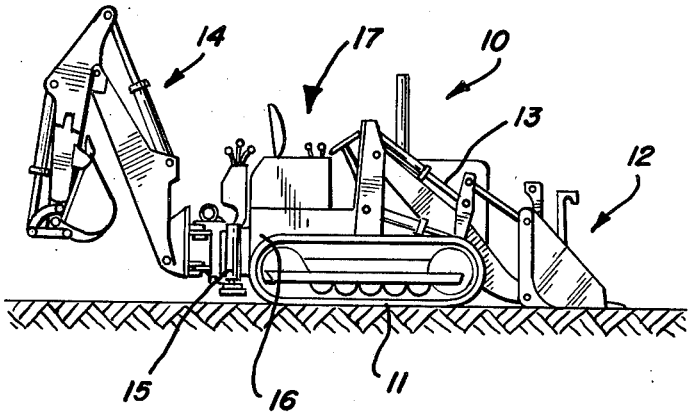
FIG. 3
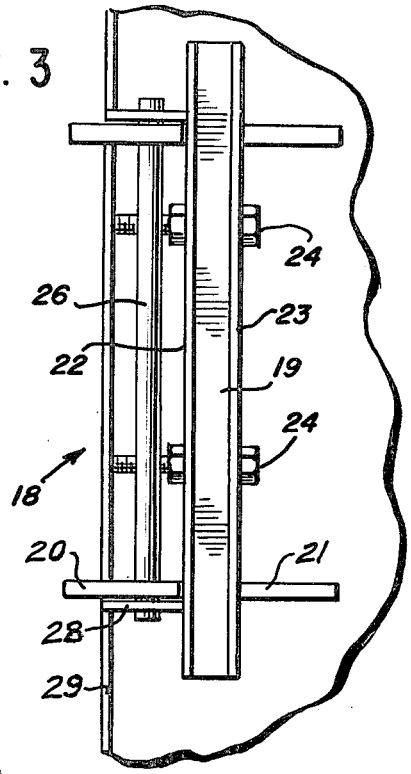
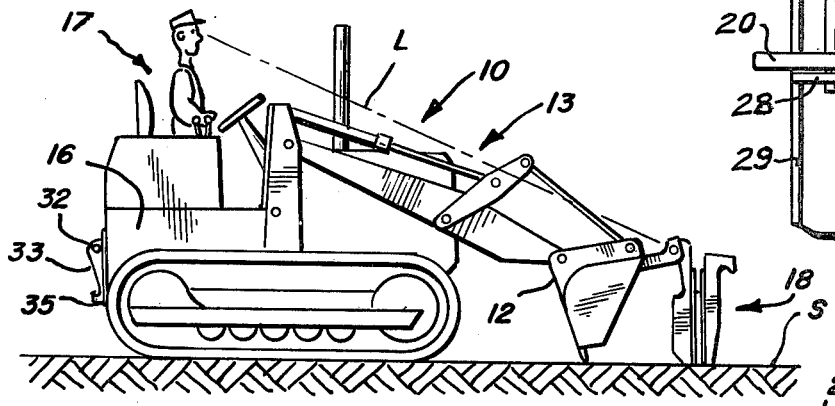
FIG. 2
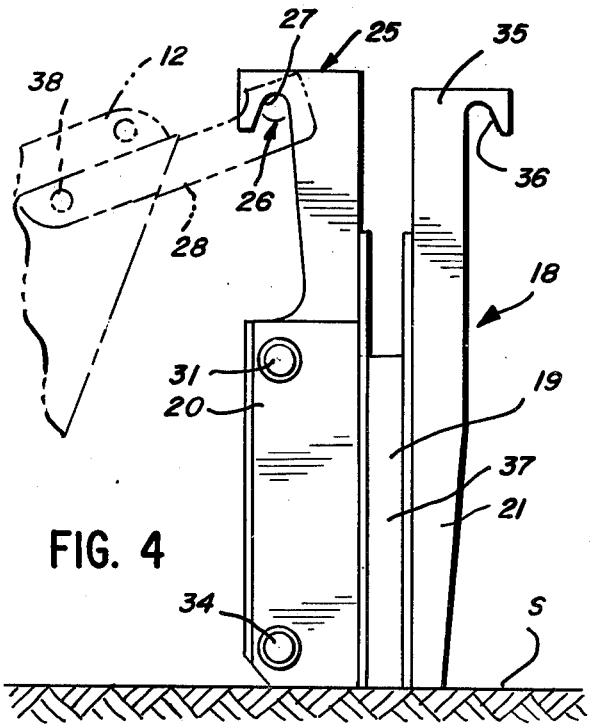
FIG. 4
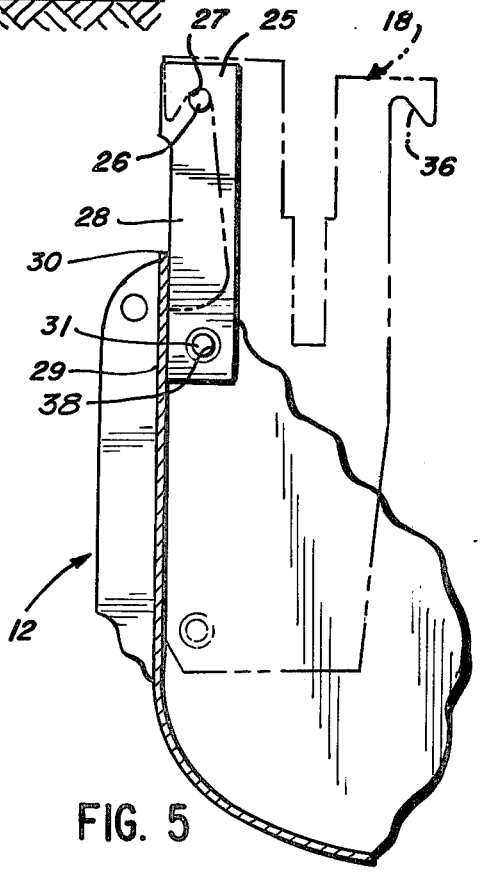
FIG. 5

MEANS FOR COUNTERBALANCING A MATERIAL HANDLING MACHINE

BACKGROUND OF THE INVENTION

1. Field of the Invention

This invention relates to material handling machines and in particular to means for counterbalancing material handling machines.

2. Description of the Prior Art

In U.S. Pat. No. 3,998,342 of Jimmy D. Myers, one of the joint inventors herein, which patent is owned by the assignee hereof, an improved counterweight attachment means for loaders and the like is disclosed. As shown therein, the counterweight may be selectively mounted on the material handling structure carried on a pair of lift arms at the front of the machine. For this purpose, the counterweight is provided with hooking means adapted to engage a hook support carried on a bracket mounted to the bucket defining the material handling structure. Illustratively, the counterweight may then counterbalance the machine such as where a backhoe or the like is mounted to the rear end of the machine.

As further disclosed in said patent, the machine may comprise a tractor-type vehicle having an operator's station wherein the operator of the vehicle is provided with suitable controls for effecting the desired material handling operations. The controls may include means for lifting the bucket by means of the lift arms and, thus, the operator may control the pickup of the counterweight by the bracket on the bucket from the operator's station.

However, as disclosed in said patent, the hooking means on the counterweight is disposed at a relatively low elevation which makes the viewing of the hooking means by the operator at the operator's station relatively difficult because of portions of the apparatus interposed between the hooking portion of the counterweight and the operator. As shown in said patent, the hooking means on the counterweight is disposed slightly below the top of the weight portion of the counterweight which extends the full height thereof.

As further shown in said patent, the bucket defining the front material handling structure is provided with a bracket extending upwardly from the rear wall of the bucket so that the counterweight is effectively hung on the bracket substantially upwardly of the bucket in the picked-up position wherein the bucket effectively opens upwardly with the rear wall of the bucket being spaced substantially below the lower portion of the counterweight.

As further shown in said patent, the counterweight is adapted to be mounted selectively on the backhoe, which may comprise a second material handling structure and which may be removably installed on the rear end of the vehicle. Upon removal of the backhoe from the rear end of the vehicle, the counterweight may be installed on a second bracket means carried on the rear end of the vehicle so as to counterbalance the machine for use thereof as a conventional front loader or bulldozer. Thus, the counterweight may have a number of hooking portions selectively engageable with the different carrying means of the front material handling structure, the rear material handling structure, and the rear bracket carried by the rear end of the vehicle.

SUMMARY OF THE INVENTION

The present invention comprehends an improved means for counterbalancing such a material handling machine wherein the counterweight has an upper hooking portion which is spaced substantially above the weight portion thereof so as to permit an operator disposed in a normal operating position in the operator compartment of the machine to view the counterweight upper hooking portion with the counterweight resting in an upright position on the surface carrying the machine. The lift arms and front material handling structure of the machine are preferably disposed below the line of sight of the operator so that a relatively unobstructed viewing of the pickup means during the pickup operation is provided.

In the illustrated embodiment, the counterweight defines a center of gravity which is relatively low, with the upper hooking portion thereof being disposed at a level substantially above the center of gravity.

In the illustrated embodiment, the upper hooking portion is defined by a bracket mounted to the weight portion.

The engaging means on the material handling structure may comprise a bracket extending upwardly therefrom and, in the illustrated embodiment, the material handling structure bracket may extend generally parallel upwardly from the rear wall of the material handling structure which, in the illustrated embodiment, comprises a bucket. Thus, in the present invention, the counterweight is arranged to extend vertically substantially in abutment with the vertical upright rear wall of the bucket when the counterweight is lifted to a counterbalancing position in the machine.

The counterweight may be provided with a second bracket at the side thereof opposite the side to which the first bracket is secured, the second bracket being adapted for mounting of the counterweight on the material handling structure removably secured to the rear end of the tractor when desired. Thus, the counterweight may be selectively temporarily retained on the rear material handling structure in effecting a transfer of the counterweight from the front material handling structure to the rear end of the machine to permit the counterweight to then be used as a means for counterbalancing the machine when used as a front loader, or the like.

In the illustrated embodiment, the hooking means defined by each of the brackets are disposed substantially above the level of the weight portion of the counterweight for facilitated manipulation of the counterweight in the transfer and mounting thereof to the different portions of the machine, as discussed above.

In the illustrated embodiment, the brackets define downwardly opening recesses forming hooks adapted to engage suitable corresponding rods, or the like, carried by the machine and defining the hook-engaging means thereof adapted to support the counterweight in the counterbalancing functioning.

Thus, the counterbalancing means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a side elevation of a material handling machine having a counterbalancing means embodying the invention installed on a front material handling structure thereof such as for use in counterbalancing the machine when the machine is used in conjunction with a material handling structure at the rear thereof;

FIG. 2 is a side elevation illustrating one step in the pickup of the counterweight by the counterweight engaging means carried by the front material handling structure;

FIG. 3 is a fragmentary top plan view illustrating the mounting of the counterweight on the front material handling structure supporting means;

FIG. 4 is a fragmentary enlarged side elevation of a portion of the illustration of FIG. 2 showing in greater detail the counterbalancing means; and FIG. 5 is a fragmentary vertical section illustrating the mounting of the counterweight to the front material handling structure, in the lifted counterbalancing arrangement thereof.

DESCRIPTION OF THE PREFERRED EMBODIMENT

In the exemplary embodiment of the invention as disclosed in the drawing, a material handling machine generally designated 10 is shown to comprise a loader tractor including transporting track means 11, a front loader bucket 12 carried on suitable front lift arms 13, and a rear backhoe attachment 14 carried on a suitable support 15 removably mounted to the rear 16 of the tractor. Operation of the lift arms and front and rear material handling structures 12 and 14, respectively, may be effected by an operator disposed in an operator compartment, or space, 17 in an upper rear portion of the vehicle.

The present invention is concerned with the provision of counterbalancing means for counterbalancing the machine selectively when it is used as a backhoe machine in the arrangement of FIG. 1, or, when it is used as a front loader in the arrangement of FIG. 2 wherein the backhoe has been removed from the vehicle. The counterbalancing means includes a counterweight generally designated 18 which may be selectively installed on the bucket 12, the backhoe 14, or the rear portion 16 of the vehicle, as will be brought out more fully hereinafter. As indicated briefly above, the selective mounting of a counterweight on such a machine for use in counterbalancing the machine in the different arrangements thereof is broadly disclosed in the U.S. Pat. No. 3,998,342. The present invention is concerned with an improved arrangement of the counterweight affording greater facility in the manipulation and use of the counterweight in effecting the desired counterbalancing.

More specifically, as illustrated in FIG. 2, when it is desired to utilize the counterweight as a counterbalancing means at the front end of the machine 10, the operator effects a suitable manipulation of the bucket by controlling the lift arms 13 to lift the counterweight from the subjacent ground surface S on which it is resting and bring the counterweight to a counterbalancing disposition, as illustrated in FIG. 5, wherein the counterweight is mounted to the bucket 12. Thus, as shown in FIG. 2, when the operator is in a normal operating position within the operator space 17 and the bucket 12 and lift arms 13 are disposed in a lowermost pickup position wherein the bucket also rests on the subjacent surface S, the operator's line of view L is above the thusly lowered bucket and lift arms, permitting the operator to view the upper portion of the counterweight 18 for facilitated manipulation thereof in picking up the counterweight.

Referring now more specifically to FIGS. 3–5, the counterweight 18 includes a weight portion 19, a rear bracket means 20, and a front bracket means 21. Rear bracket means 20 includes a clamping wall portion 22 and front bracket means 21 includes a clamping wall portion 23 between which the weight portion 19 is secured as by suitable removable securing means 24, illustratively comprising nut and bolt means. Thus, additional weights may be included in the weight means 19 as desired for providing the desired counterbalancing effect in the machine 10.

The invention comprehends the provision of a hook means generally designated 25 at the upper end of the bracket means 20 to have removable engagement by an engaging portion 26 on the bucket 12. In the illustrated embodiment, hook means 25 comprises a pair of downwardly opening recesses and engaging means 26 comprises a support bar removably received in the recesses 27 by an upward movement of the support bar thereinto. The support bar is carried on a bracket 28 secured to the rear wall 29 of the bucket 12. As shown, the bracket extends generally parallel to rear wall 29 and projects a short distance upwardly from the rear wall.

As shown in FIGS. 2 and 4, when the bucket 12 is arranged in the lower pickup position, the bracket 28 extends generally forwardly from the vehicle to dispose the pickup rod 26 in the line of sight L. Thus, the operator may readily control the movement of the engaging rod 26 relative to the hook means 25 for facilitated pickup of the counterweight from the operator space.

The operator may concurrently lift the counterweight and pivot the bucket by means of the lift arms and associated apparatus so as to bring the bucket to a carrying position shown fragmentarily in FIG. 5, wherein the rear wall 29 thereof extends substantially vertically. In this arrangement, the counterweight, which is swung on the rod 26, hangs substantially vertically downwardly therefrom with the lower portion thereof contacting the rear wall 29 to substantially below top edge 30 thereof, thereby effectively positioning the counterweight in the counterbalancing arrangement of FIG. 5.

As further shown in FIG. 4, the bracket 20 includes a removable pin 31 adapted to be engaged in an upper portion 32 of a bracket 33 carried on the rear portion 16 of the tractor. Bracket 20 further includes a lower pin 34 for engaging a lower hook portion 35 of the bracket 33. Thus, pins 31 and 34 cooperate with the bracket 33 in removably mounting the counterweight to the rear of the tractor when it is desired to use the machine as a front loader. As shown in FIG. 4, pin 31 may be inserted into hole 38 to retain the counterweight to the lower end of bracket 28 thereby securing the counterweight against movement relative to the bucket during operation of the machine.

As further shown in FIG. 4, the counterweight 18 front bracket 21 defines an upper portion 35 provided with a hook recess 36 which may engage suitable support rod means on the backhoe 14 (not shown) as for temporarily supporting the counterweight in transferring the same from the bucket 12 to the rear bracket 33 in the manner disclosed in U.S. Pat. No. 3,998,342 discussed above. As shown in FIG. 4, the hook recess 36 is disposed substantially above the top of the weight portion 19 of the counterweight and closely adjacent the level of the hook recess 27 of hook means 25. Thus, the hook means defined by the recesses 27 and 36 are substantially above the center of gravity 37 of the counterweight 18, thereby facilitating the manipulation and transfer of the counterweight, as well as providing improved retention of the counterweight in the mounted disposition on either of the bracket 28 or bracket 33 at the opposite ends of the material handling machine.

The foregoing disclosure of specific embodiments is illustrative of the broad inventive concepts comprehended by the invention.

The embodiments of the invention in which an exclusive property or privilege is claimed are defined as follows:

1. In a material handling machine having an elevated operator compartment, lift arms extending away from one end of the machine and having a distal end carrying a material handling structure, improved means for permitting one man selective counterbalancing of said machine comprising:

a counterweight;

connecting means carried by said counterweight defining an upper hooking portion; and engaging means on said material handling structure for engaging said hooking portion of the counterweight connecting means as an incident of raising said engaging means on said material handling structure from a lowermost pickup position wherein said material handling structure is disposed to cause the counterweight to be below the line of sight of an operator disposed in a normal operating position in said operator compartment looking over said material handling structure, said counterweight upper hooking portion extending above the counterweight to a point where it can be seen over said material handling structure in said pickup position with said counterweight resting in an upright position on the surface carrying the material handling machine and with said upper hooking portion disposed uppermost, and said engaging means being disposed to be seen by said operator when raised from said pickup position to engage said hooking portion of said material handling structure.

2. The material handling machine of claim 1 wherein said counterweight defines a center of gravity and said upper hooking portion is disposed at a level at least twice the height of said center of gravity when the counterweight is disposed in said upright position.

3. The material handling machine of claim 1 wherein said counterweight includes a weight portion and a bracket portion, said bracket portion having a height at least approximately twice the height of said weight portion, an upper portion of said bracket defining said counterweight hooking portion.

4. The material handling machine of claim 1 wherein said material handling structure engaging means comprises an upwardly extending bracket having a lift element adapted to have removable hooked association with said counterweight hooking portion.

5. The material handling machine of claim 1 wherein said material handling structure engaging means comprises an upwardly extending bracket having a lift element adapted to have removable hooked association with said counterweight hooking portion, said counterweight hooking portion defining a downwardly opening hook and said lift element comprising a support member adapted to be raised into lifting association with said hook.

6. The material handling machine of claim 1 wherein said machine includes a counterweight support at the end opposite said one end and said counterweight includes a second hooking portion for supporting the counterweight on said counterweight support, said second hooking portion being disposed proximate the level of said first named hooking portion when said counterweight is in said upright position.

7. The material handling machine of claim 1 wherein said counterweight includes a weight portion and a pair of brackets one each at opposite sides of the weight portion and projecting substantially upwardly therefrom, one of said brackets defining at its upper end said upper hooking portion and the other of said brackets defining a second hooking portion, said machine having a second engaging means for engagement by said second hooking portion whereby said counterweight may be installed on said second engaging means when desired.

8. The material handling machine of claim 1 wherein said counterweight includes a second hooking means, and said machine is provided with a second counterweight engaging means for engagement by said second hooking means.

9. The material handling machine of claim 1 wherein said counterweight includes a bracket defining said upper hooking portion and a second hooking means, said machine being provided with a second counterweight engaging means for engagement by said second hooking means.

10. The material handling machine of claim 1 wherein said engaging means comprises a bracket upstanding from said material handling structure when said material handling structure is in an upright counterweight-carrying position.

11. The material handling machine of claim 1 wherein said material handling structure comprises a bucket having a rear wall and said engaging means comprises a bracket upstanding from said material handling structure rear wall when said material handling structure is in an upright counterweight-carrying position.

12. The material handling machine of claim 1 wherein said material handling structure comprises a bucket having a rear wall and said engaging means comprises a bracket upstanding from said material handling structure rear wall when said material handling structure is in an upright counterweight-carrying position, said rear wall and counterweight extending substantially vertically in the counterweight-carrying position.

* * * * *